US008881431B2

(12) United States Patent
Sink

(10) Patent No.: US 8,881,431 B2
(45) **Date of Patent: *Nov. 11, 2014**

(54) SHOE WITH PROTRUSIONS AND SECURING PORTIONS

(71) Applicant: K-Swiss, Inc., Westlake Village, CA (US)

(72) Inventor: Jeffrey A. Sink, Redwood City, CA (US)

(73) Assignee: K-Swiss, Inc., Westlake Village, CA (US)

( * ) Notice: Subject to any disclaimer, the term of this patent is extended or adjusted under 35 U.S.C. 154(b) by 15 days.

This patent is subject to a terminal disclaimer.

(21) Appl. No.: 13/758,690

(22) Filed: Feb. 4, 2013

(65) Prior Publication Data

US 2013/0152429 A1 Jun. 20, 2013

Related U.S. Application Data

(63) Continuation of application No. 12/117,824, filed on May 9, 2008, now Pat. No. 8,365,445.

(60) Provisional application No. 60/931,513, filed on May 22, 2007.

(51) Int. Cl.

| | |
|---|---|
| ***A43B 5/00*** | (2006.01) |
| ***A43B 13/18*** | (2006.01) |
| ***A43B 13/00*** | (2006.01) |
| ***A43B 7/32*** | (2006.01) |
| ***A43B 13/14*** | (2006.01) |
| ***A43B 13/20*** | (2006.01) |

(52) U.S. Cl.

CPC ..... *A43B 7/32* (2013.01); *A43B 13/145* (2013.01); *A43B 13/181* (2013.01); *A43B 13/206* (2013.01)

USPC ..... 36/103; 36/28; 36/114

(58) Field of Classification Search

CPC ..... A43B 13/145; A43B 13/16; A43B 7/32; A43B 13/206; A43B 13/181

USPC ..... 36/102, 103, 31, 15, 25 R, 59 C, 28, 88

See application file for complete search history.

(56) References Cited

U.S. PATENT DOCUMENTS

| | | | |
|---|---|---|---|
| 1,929,126 | A | 10/1933 | Tuki et al. |
| 2,100,492 | A | 11/1937 | Sindler |
| 2,627,676 | A | 2/1953 | Hack |
| 2,710,461 | A | 6/1955 | Hack |

(Continued)

FOREIGN PATENT DOCUMENTS

| | | | |
|---|---|---|---|
| AU | 613915 | B2 | 8/1991 |
| CN | 2299493 | Y | 12/1998 |

(Continued)

*Primary Examiner* — Jila M Mohandesi

(74) *Attorney, Agent, or Firm* — Rothwell, Figg, Ernst & Manbeck, P.C.

(57) ABSTRACT

A shoe sole structure includes a midsole body that extends from the heel region to the forefoot region of a shoe and an outsole that is attached to the midsole body. The outsole includes a plurality of protrusions arranged transversely to the longitudinal axis of the shoe, while extending at least partially between the lateral edge and the medial edge of the shoe. One or more of the half tube structures can include grooves and/or projections to enhance traction on a contact surface.

19 Claims, 3 Drawing Sheets

(56) References Cited

U.S. PATENT DOCUMENTS

| | | | | |
|---|---|---|---|---|
| 3,019,534 | A | | 2/1962 | Kauffman et al. |
| 3,533,171 | A | * | 10/1970 | Motoki Tomiharu ..... 36/3 B |
| 3,719,965 | A | * | 3/1973 | Chevallereau ..... 12/146 B |
| 4,071,963 | A | | 2/1978 | Fukuoka |
| 4,130,947 | A | * | 12/1978 | Denu ..... 36/30 R |
| 4,297,797 | A | | 11/1981 | Meyers |
| 4,445,283 | A | | 5/1984 | Meyers |
| 4,445,284 | A | | 5/1984 | Sakutori |
| 4,521,979 | A | | 6/1985 | Blaser |
| 4,523,393 | A | | 6/1985 | Inohara |
| 4,536,974 | A | | 8/1985 | Cohen |
| 4,593,482 | A | | 6/1986 | Mayer |
| 4,611,412 | A | | 9/1986 | Cohen |
| 4,658,514 | A | | 4/1987 | Shin |
| 4,753,021 | A | | 6/1988 | Cohen |
| 4,754,559 | A | | 7/1988 | Cohen |
| 4,782,603 | A | | 11/1988 | Brown |
| 4,833,795 | A | | 5/1989 | Diaz |
| 4,864,738 | A | | 9/1989 | Horovitz |
| 4,910,884 | A | | 3/1990 | Lindh et al. |
| 5,005,300 | A | | 4/1991 | Diaz et al. |
| 5,079,856 | A | | 1/1992 | Truelsen |
| 5,117,566 | A | | 6/1992 | Lloyd et al. |
| 5,337,492 | A | * | 8/1994 | Anderie et al. ..... 36/28 |
| 5,461,800 | A | | 10/1995 | Luthi et al. |
| 5,686,167 | A | | 11/1997 | Rudy |
| 5,713,140 | A | | 2/1998 | Baggenstoss |
| 5,761,833 | A | | 6/1998 | McMullin |
| 5,822,886 | A | | 10/1998 | Luthi et al. |
| 6,209,226 | B1 | | 4/2001 | Squadroni |
| 6,305,100 | B1 | * | 10/2001 | Komarnycky et al. ..... 36/3 R |
| 6,516,540 | B2 | | 2/2003 | Seydel et al. |
| 6,915,596 | B2 | | 7/2005 | Grove et al. |
| 7,013,582 | B2 | | 3/2006 | Lucas et al. |
| 7,181,866 | B2 | | 2/2007 | Braunschweiler |
| 7,181,867 | B2 | * | 2/2007 | Litchfield et al. ..... 36/29 |
| 7,272,897 | B2 | * | 9/2007 | Yu ..... 36/11.5 |
| 7,444,763 | B2 | | 11/2008 | Grove et al. |
| 7,500,324 | B1 | | 3/2009 | Power et al. |
| 2001/0011427 | A1 | | 8/2001 | Seydel et al. |
| 2002/0038522 | A1 | | 4/2002 | Houser et al. |
| 2004/0154189 | A1 | | 8/2004 | Wang |
| 2005/0115107 | A1 | | 6/2005 | Schumacher |
| 2005/0252038 | A1 | | 11/2005 | Braunschweiler |

FOREIGN PATENT DOCUMENTS

| | | | |
|---|---|---|---|
| DE | 3832743 | A1 | 4/1990 |
| DE | 19520374 | A1 | 5/1996 |
| DE | 29715533 | U1 | 3/1998 |
| EP | 1264556 | A1 | 12/2002 |
| FR | 2695809 | A1 | 3/1994 |
| FR | 2709929 | A1 | 3/1995 |
| GB | 2001843 | A | 2/1979 |
| GB | 2285569 | A | 7/1995 |
| JP | S49-69158 | | 12/1972 |
| JP | 60253402 | A | 12/1985 |
| JP | 63311903 | | 12/1988 |
| JP | 5309001 | A | 11/1993 |
| JP | 06-050508 | U | 7/1994 |
| JP | H07-284403 | A | 10/1995 |
| JP | 8205907 | A | 8/1996 |
| JP | 2000-166605 | A | 6/2000 |
| RU | 2085096 | C1 | 7/1997 |
| WO | 81/01234 | A1 | 5/1981 |
| WO | WO 90/00021 | A1 | 1/1990 |
| WO | WO 91/11928 | A1 | 8/1991 |
| WO | WO 98/21991 | A1 | 5/1998 |
| WO | WO 99/51118 | A1 | 10/1999 |
| WO | WO 02/37995 | A1 | 5/2002 |

* cited by examiner

SHOE WITH PROTRUSIONS AND SECURING PORTIONS

CROSS-REFERENCE TO RELATED APPLICATIONS

This application claims priority to U.S. application Ser. No. 12/117,824, filed May 9, 2008, and U.S. Provisional Application Ser. No. 60/931,513, filed May 22, 2007.

BACKGROUND OF THE INVENTION

1. Field of the Invention

This invention relates to sport or athletic shoes. According to an example, the shoes are constructed to minimize impact shock and to increase stability and support.

2. Description of the Related Art

In most types of footwear, especially athletic shoes, the lower or underfoot portion of the shoe includes a midsole, which is directly attached to the shoe upper portion. An outsole is attached to the midsole and is generally designed to resist wear and provide traction. The midsole is designed primarily to provide stability for the foot while attenuating shock.

When running and walking, generally the foot makes initial contact with the ground surface on the lateral portion of the rearfoot area. At initial contact, runners typically strike the ground at a force of 2.5 times their body weight, which may be repeated at a rate of 180 times per minute (90 per each foot). Therefore, the heel strike cushioning material, which is contained mostly in the midsole of a running or walking shoe must have a firmness to provide for proper impact cushioning. If the midsole material is too soft, the material will "bottom out" before heel impact is completely absorbed, and shock-related injuries could result. Softer midsoles also offer poor lateral stability that can also result in injuries.

The modern athletic shoe is a combination of elements, which cooperatively interact in an effort to minimize weight and maximize comfort, cushioning, stability and durability. However, these goals are potentially in conflict with each other and in an effort to achieve one of these objectives, a deleterious effect on one or more of the other goals can occur.

The cushioning in most athletic shoes is supplied through the foam midsole that can be made from either ethylene vinyl acetate (EVA) or polyurethane. These materials provide ample cushioning when they are new, but lose some of the cushioning ability over time due to failure of the structured materials by the application of shear and vertical forces applied to them.

A shoe industry trend has been toward thickening the midsoles of athletic shoes to enhance the cushioning effect of the sole. An added thickness of foam, however, can cause the sole to have increased stiffness in bending. Under these conditions, the lateral corner of the sole can tend to operate as a fulcrum upon heel strike and create an extended lever arm and greater moment, which can cause the foot to rotate medially and pronate with greater velocity than desired. This can lead to over-pronation of the foot and possible injury. Further, this condition can present a potentially unstable condition for the foot and result in the transmission of higher than desired levels of impact stress due to the relatively small surface area of contact.

SUMMARY OF THE INVENTION

According to an aspect of the invention, it has been recognized that prior shoe designs suffer from one or more disadvantages including: a midsole that is too soft so as to provide poor lateral support and not completely absorb an impact, and thicker midsoles that can result in over-pronation of the foot and possible injury.

The present invention relates to improved shoes that address the competing concerns of cushioning and stability with the ground support phase of running and walking in both the heel strike area and the forefoot area.

According to an example, the invention pertains to athletic footwear used for running and walking. More specifically, an example pertains to athletic shoe constructions designed to attenuate applied force and shock, and to provide support and stability during running and walking.

In one example, the invention utilizes the outsole of a shoe to provide increased shock absorption upon impact, while transitioning into stability and support during running and walking.

A shoe according to another example of the invention provides improved shock absorption upon heel strike without relying on soft midsoles to obtain the needed shock absorption during both the initial heel impact and the forefoot impact during running and walking.

In one example, the athletic footwear includes an upper, a midsole attached to the upper, and a sole attached to the midsole. According to an improvement, the sole of the shoe includes one or more protrusions extending transversely to the longitudinal axis of the shoe. As an example, the protrusions can be in the shape of a half tube and can extend across the width of the sole.

In one preferred embodiment, the rear sole incorporates one or more slots or grooves along at least part of the length of at least one of the half tube tread members. For example, the slots could be located in front of and behind the intended heel strike area of the half tube tread member. These slots reduce the wall thickness of the half tube tread member, allowing for more flex or compression of the half tube tread member to provide shock absorption. As an example, one or more tube members could have one or more grooves that extend different lengths across the length of the tube member.

In an alternative embodiment, each half tube tread member can be provided with projections, for example raised cleats, instead of or in addition to grooves, to increase the wall thickness in selected areas and to provide traction and durability.

As an example of the invention, each half tube tread member can have a different wall thickness. The difference in wall thickness can be based on which area of the foot is in contact with the ground surface. In an example, the wall thickness of the half tube tread members in the rear lateral portion is thicker than the center of the rear portion to allow more flex or bending of the half tube after initial contact. That is, as the foot makes contact with the ground, one or more of the half tube tread members begin to collapse or bend upward, absorbing shock of the impact upon landing on a firm surface.

In a further example, each of one or more tube members can vary in thickness in the longitudinal direction of the shoe. For example, a tube member could have a thicker wall thickness at the beginning and/or ending of the tube member than a portion of the tube member near a middle of the tube member.

As a further example, one or more tube members can vary in thickness along the length of the tube member. Embodiments of the present invention have a plurality of half tube shaped tread members adjacent to each other and extending transversely between the lateral side edge to the medial side edge of the midsole. In one preferred embodiment, the lateral side of the outsole has thinner walls than the medial side so that upon contact, more shock absorption is available.

According to an example, the half tube tread members include approximately one half of the circumference of a tube.

According to an example, the shoe midsole includes cavities that extend from the lateral side of midsole to the medial side. Each cavity receives a portion of the outsole formed between adjacent half tube tread members.

As should be apparent, the invention can provide a number of advantageous features and benefits. It is to be understood that in practicing the invention, an embodiment can be constructed to include one or more features or benefits of embodiments disclosed herein, but not others. Accordingly, it is to be understood that the preferred embodiments discussed herein are provided as examples and are not be construed as limiting, particularly since embodiments can be formed to practice the invention that do not include each of the features of the disclosed examples.

BRIEF DESCRIPTION OF THE DRAWINGS

The invention will be better understood from reading the description which follows and from examining the accompanying figures. These are provided solely as non-limiting examples of the invention. In the drawings.

DETAILED DESCRIPTION OF THE PREFERRED EMBODIMENTS

Figure 1:
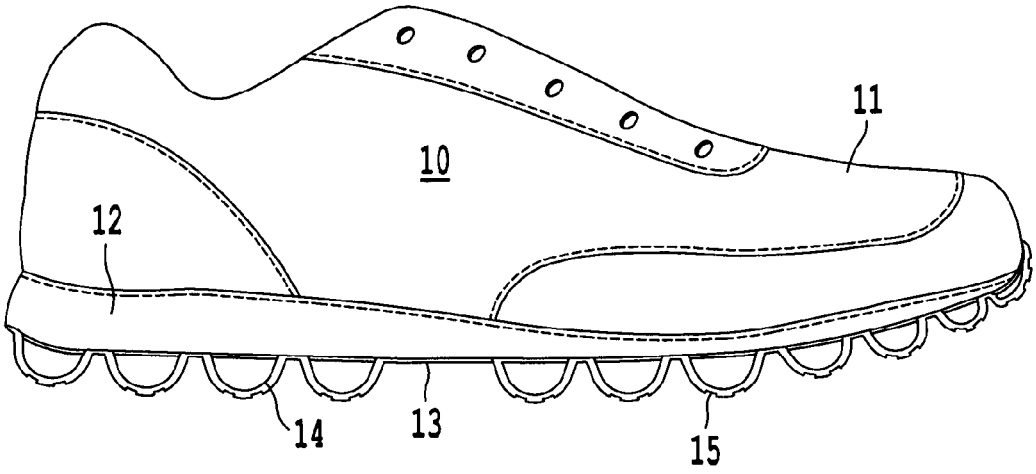
FIG. 1 is a side view of the lateral side of an athletic shoe according to an example of the invention.

Reference will now be made in detail to the present preferred embodiments of the invention, examples of which are illustrated in the accompanying drawings. Wherever possible, the same reference characters will be used throughout the drawings to refer to the same or like parts.

FIG. 1 is a side view of an athletic shoe 10 according to one example of the present invention. An upper portion 11 of athletic shoe 10 is typically fabricated from for example, stitched fabric, leather, canvas or other types of synthetic materials. The upper portion 11 also includes a midsole portion 12 that is attached to upper portion 11 and can be made from for example, a foam or soft rubber type material. Attached to the midsole 12 of the athletic shoe 10 is an outsole 13.

According to embodiments of the invention, the outsole 13 can include a plurality of protrusions 14. The protrusions 14 can be in the shape of a half tube. For example, the half tube tread members 14 incorporate an approximately 180 degree configuration. That is, the half tubes include approximately one half of the circumference of a tube. A further example provides for a configuration of the half tube that satisfies a condition within the range of 150 degrees to 190 degrees.

It should be appreciated that the protrusion of one or more examples of the invention can be any desirable shape. The half tube tread member 14 can be made from a flexible material, such as rubber or urethane. The half tube tread members 14 on outsole 13 can be provided immediately adjacent each other or can be spaced apart as discussed with respect to FIG. 5.

Figure 2:
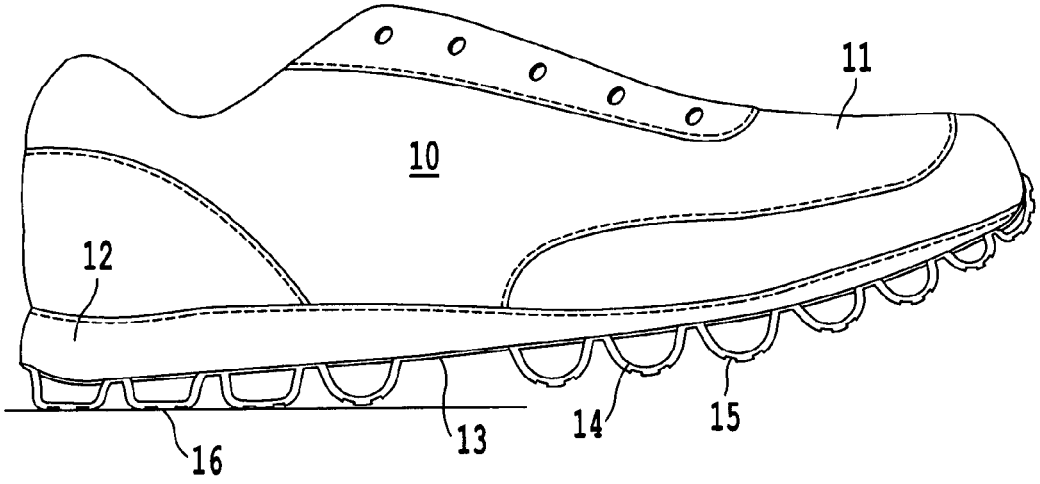
FIG. 2 is an elevation view of the lateral side of an athletic shoe according to an example of the invention.

FIG. 2 shows a medial view of an athletic shoe 10 according to an example of the present invention. When the athletic shoe 10 comes in contact with a firm surface, half tube tread members 14, which can have a curved exterior ground contacting surface, are provided on outsole 13 and will deflect or compress 16 upon impact to absorb shock. As discussed further below, the amount of deflection or compression on half tube tread member 14 can be derived from the firmness of the material used on outsole 13 and/or the wall thickness of half tube tread member 14.

Figure 3:
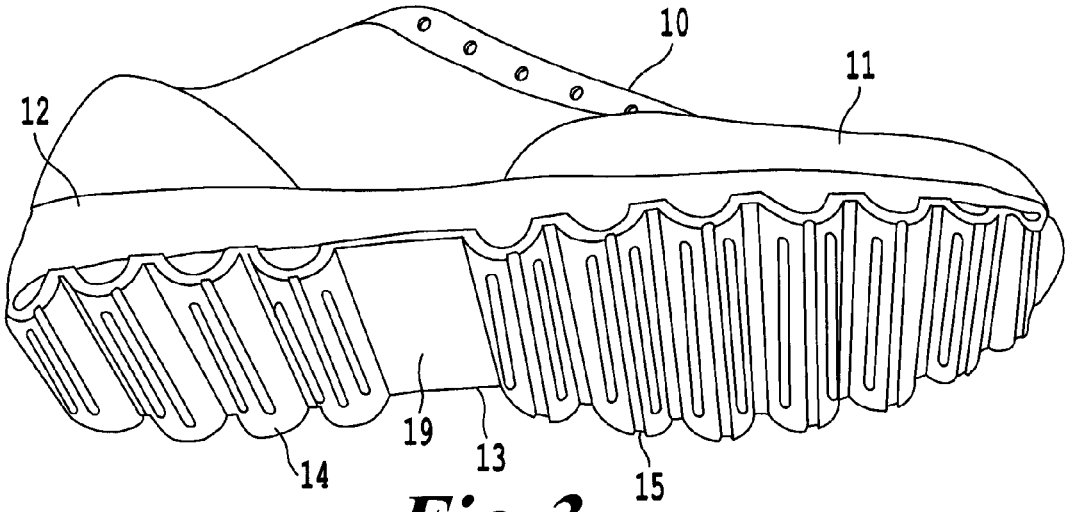
FIG. 3 is a bottom view of the under side of an athletic shoe according to an example of the invention.

FIG. 3 is a lateral tilt view of athletic shoe 10 showing outsole 13 with multiple half tube tread members 14 adjacent to each other and extending from the rear of athletic shoe 10 to the front of the athletic shoe. In this embodiment, the tube members 14 are positioned substantially transverse to the longitudinal direction of the shoe and extend from the outer lateral portion of outsole 13 to the inner medial portion of outsole 13. It should be appreciated that each tube member 14 can extend a different distance across the width of the shoe, for example, completely or partially across the width. Further, as shown in FIG. 3, a gap 19 between the tube members of the heel portion and tube members of the forefoot portion is provided. However, examples of the invention include tube members 14 that are provided along the entire length of the outsole 13.

In one preferred embodiment, each half tube tread member 14 has one or more grooves 15 to allow for traction on different types of surfaces. As shown from FIG. 3, the grooves 15 can extend the length of the tube members, that is, extend from the lateral side of the tube member to the medial side of the tube member or the grooves can extend only a portion of the length of the tube member. In an example, a single tube member could have some grooves 15 that extend the entire length and other grooves 15 that extend only part of the length of the tube member. Further, the grooves 15 can be formed at any location along the half tube tread members. It should be appreciated that the grooves can have a different depths than other grooves 15 formed on the same tube member. Further, grooves 15 of one tube member 14 can have different depths than grooves 15 formed in other tube members 14. Even further, examples of the invention provide for the grooves 15 to extend on one or more tube members 14 in the longitudinal direction of the shoe.

Figure 4:
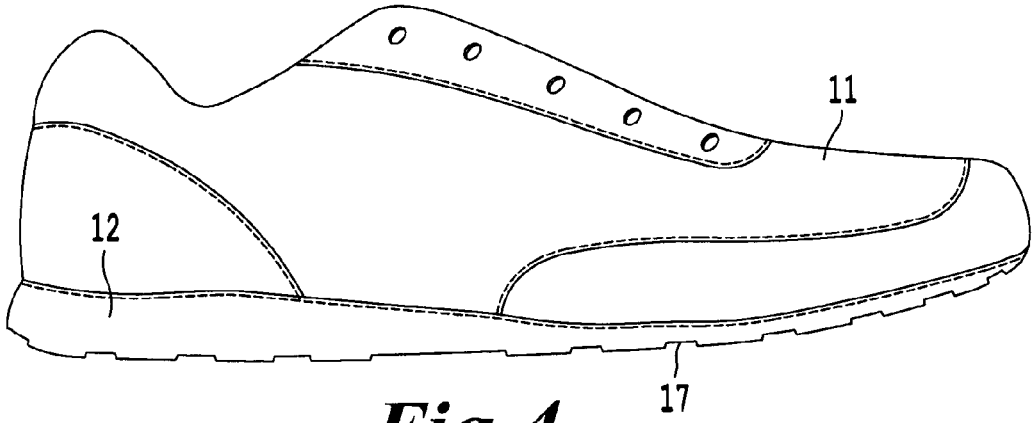
FIG. 4 is an elevation view of the lateral side of an athletic shoe according to an example of the invention prior to the outsole being attached.

FIG. 4 is a lateral view of athletic shoe 10 with only the upper 11 and midsole 12 attached to each other. An example of the invention provides for multiple cavities 17 in the midsole 12 that extend from the lateral side of midsole 12 to the medial side of the midsole. Each cavity 17 can receive a securing portion 18 of outsole 13 to secure the outsole 13 to the remainder of the shoe 10. It should be appreciated that the cavities 17 are optional and the securing portion 18 of the outsole 13 can be secured directly to the midsole using for example an adhesive, stitching, or molded together instead of being received in the cavities 17. The securing portion 18 can be a substantially flat area formed between each half tube tread member 14. That is, the area between half tube members 14 can be a connecting portion from one half tube member to another half tube tread member and also can be a securing portion to connect the outsole 13 to the remainder of the shoe 10. The securing portion 18 can extend in a widthwise direction of the shoe.

Figure 5:
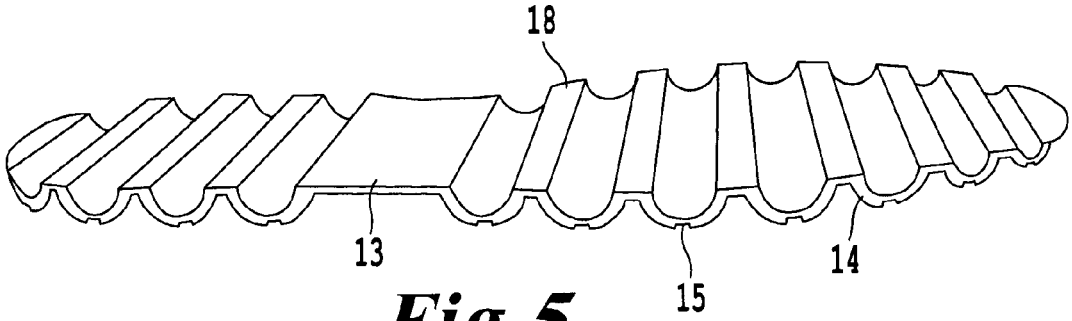
FIG. 5 is a top plan view of the outsole of the athletic shoe shown in FIG. 1.

FIG. 5 shows a top view of outsole 13 with multiple half tube tread members 14 connected to each other by the securing portion 18, which connects into cavities 17 on midsole 12 as discussed above with respect to FIG. 4. Therefore, in one embodiment of the invention, outsole 13 has a plurality of half tube tread members 14 each formed with grooves 15 extending at least partially from one side of half tube tread member 14 to the opposite side. When securing portion 18 is bonded to the midsole 12 either within cavities 17 or directly to midsole 12, a shoe is provided with enhanced stability and support upon impact due to the half tube tread members 14.

Figure 6A:
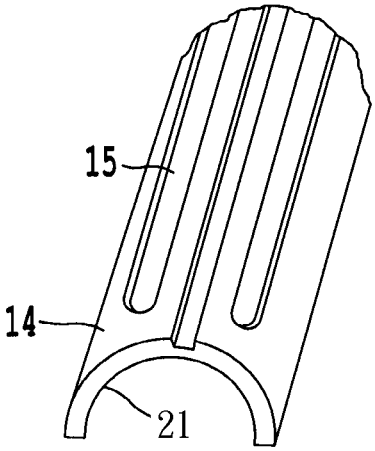
FIG. 6*a* is a top view of the half tube tread members shown in FIG. 1.

FIG. 6*a* is a cross sectional view of a half tube tread member 14. In one preferred embodiment, each half tube tread member 14 includes a plurality of grooves 15 which extend lengthwise to provide traction on a firm surface. It should be appreciated that the grooves 15 can extend differing lengths across the length of the half tube 14. In the example shown in FIG. 6*a*, a center groove 15 extends completely across the length of the tube member 14, while the grooves on either side of the center groove 15 only extend partially across the length of the tube member 14. Each groove 15 on half tube tread member 14 effectively reduces the wall thickness 21 of each half tube tread member 14, which can allow for increased deflection or compression upon impact.

Figure 6B:
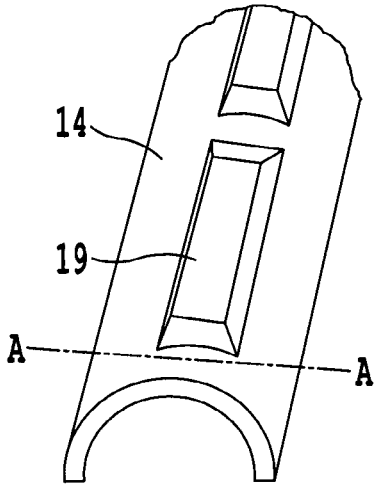
FIG. 6*b* is a top view of the half tube tread members shown in FIG. 1.

In an alternate embodiment shown in FIG. 6*b*, one or more of the half tube tread members 14 can have one or more projections 19 extending from the surface of the tube member. The projections 19 can be, for example, raised cleats that provide traction and durability on a firm surface. The one or more projections 19 can be provided instead of or in addition to the grooves 15 formed on the surface of the half tube members 14.

Figure 7A:
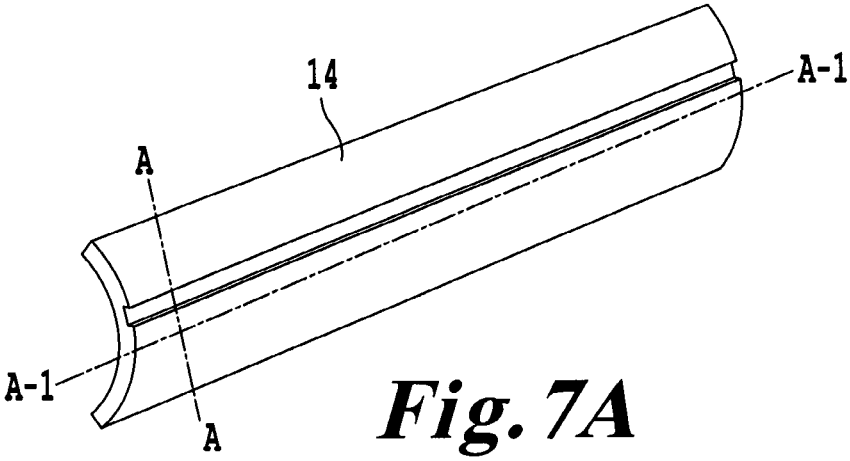
FIG. 7*a* is a top view of a half tube member of an example of the invention.
Figure 7B:
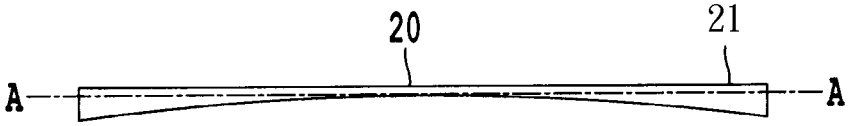
FIG. 7*b* is a cross sectional view a half tube member showing different wall thicknesses according to an example of the invention.

The amount of shock absorption each individual half tube tread member provides can be determined by either the softness of the material or the wall thickness of each half tube tread member. FIG. 7*b* is a cross sectional view of half tube tread member 14 at section A-A of FIG. 7*a*. In an example of the invention, one or more of the half tube tread members 14 can have a variable wall thickness in the lengthwise direction (A1-A1) and/or the widthwise direction (A-A) of the tube member 14. In one embodiment shown in FIG. 7*b*, half tube tread member 14 has a larger wall thickness 21 at the ends or sides which will reduce in thickness towards the top or middle portion wall thickness 20. For example, one or more half tube tread members 14 can have a thicker wall thickness 21 formed along the edges of the tread members, which is tapered to a thinner wall thickness 20 towards a middle. Providing the thickness according to this example allows for more deflection or compression upon initial contact with a firm surface.

Further, in one preferred embodiment, the lateral side of one or more tube members 14 have thinner walls than the medial side so that upon contact with a ground surface during use, more shock absorption is available. As the foot starts the rolling motion during running or walking, the sole tends to firm up as it rotates towards the medial side to prevent over pronation. As a further example of the invention, one or more half tube members 14 can have one or both of the end portions thicker than a middle portion along the length of the tube member 14. For example, the thickness can vary along the direction from a lateral to medial side or vice versa.

One or more embodiments of the present invention do not need to rely on softer or thicker midsole foams to provide adequate shock absorption and support. The mechanical compressing and flexing of the half tube tread members provides increased shock absorption that can evolve into support and stability as the half tube tread members transition from a thin wall to a thicker wall. Accordingly, one or more examples of the present invention allows for the use of a thinner and stiffer midsole material for less loss of energy during running and walking.

Obviously, numerous modifications and variations of the present invention are possible in light of the above teachings. It is therefore to be understood that within the scope of the appended claims, the invention may be practiced otherwise than as specifically described herein.

The invention claimed is:

1. A shoe that extends in a longitudinal direction between a heel region and a forefoot region of the shoe and in a transverse direction between a medial side and a lateral side of the shoe, the shoe comprising:

(a) an upper;

(b) a first sole portion, said first sole portion including:

(i) a bottom surface; and (ii) a plurality of recesses which are recessed from the bottom surface; and (c) a second sole portion, said second sole portion including:

(i) a plurality of securing portions which are secured in the recesses of the first sole portion; and (ii) a plurality of tread members extending between adjacent securing portions, wherein each tread member includes an inner surface and an outer surface, the inner surface at least partially defining a cavity within the shoe and the outer surface at least partially defining a ground contacting surface of the shoe, and wherein each cavity extends between a first opening facing towards a medial direction of the shoe and a second opening facing towards a lateral direction of the shoe such that the ends of the cavity are open to outside of the shoe.

2. A shoe according to claim 1, wherein the plurality of tread members include at least two tread members in the heel region and at least two tread members in the forefoot region, and wherein the shoe further includes an arch region between the forefoot and heel regions and which does not have tread members.

3. A shoe according to claim 2, wherein in said heel region one of said securing portions extends between and connects a first of said at least two tread members to a second of said at least two tread members, and wherein in said forefoot region another of said, securing portions extends between and connects a first of said at least two tread members to a second of said at least two tread members.

4. A shoe according to claim 3, wherein said forefoot region further includes a third tread member, and wherein a further securing portion extends between and connects said third tread member to said second tread member in said forefoot region.

5. A shoe according to claim 4, wherein at least when the shoe contacts a ground surface a bottom portion of at least one of said tread member is substantially flat.

6. A shoe according to claim 5, wherein at least some of the surfaces of the plurality of tread members have at least one groove therein.

7. A shoe according to claim 6, wherein the at least one groove is on an outer surface of at least one of the tread members.

8. A shoe according to claim 1, wherein at least some of the surfaces of the plurality of tread members have at least one groove therein.

9. A shoe according to claim 8, wherein the at least one groove is formed within the outer surface of at least one of the tread members.

10. A shoe according to claim 1, wherein at least when the shoe contacts a ground surface a bottom portion of at least one of said tread members is substantially flat.

11. A shoe according claim 10, wherein when the bottom portion of the at least one tread member is substantially flat, the inner surface and the outer surface of the at least one tread member are substantially flat.

12. A shoe comprising:

(a) an upper;

(b) a first sole portion, said first sole portion including a bottom surface having a heel region and a forefoot region, and wherein the first sole portion further includes:

(i) a first recess which is recessed from said bottom surface in said heel region; and (ii) a second recess which is recessed from said bottom surface in said forefoot region; and (c) a second sole portion, said second sole portion including a plurality of tread members, wherein each of the plurality of the tread members includes an inner surface and an outer surface, the inner surface at least partially defining a cavity within the shoe and the outer surface at least partially defining a ground contacting surface of the shoe, and wherein each cavity extends between a first opening facing in a medial direction of the shoe and a second opening facing in a lateral direction of the shoe such that the ends of the cavity are open to outside of the shoe, and wherein the second sole portion and the plurality of tread members include:

(i) a first tread member in said heel region;

(ii) a second tread member in said heel region;

(iii) a first securing portion extending between and connecting said first tread member and said second tread member, and wherein said first securing portion is secured in said first recess of said first sole portion;

(iv) a third tread member in said forefoot region;

(v) a fourth tread member in said forefoot region; and (vi) a second securing portion extending between and connecting said third tread member and said fourth tread member, wherein said second securing portion is secured in said second recess of said first sole portion.

13. A shoe according to claim 1, wherein each of the plurality of tread members is in the form of a tubular tread member.

14. A shoe according to claim 1, wherein each of the plurality of tread members is in the form of a half tube shaped tread member.

15. A shoe according to claim 1, wherein each of the plurality of tread members is in the form of a half tube tread member including approximately one half of the circumference of a tube.

16. A shoe according to claim 12, wherein at least some of the walls of the plurality of tread members have at least one groove therein.

17. A shoe according to claim 12, wherein said first sole portion further includes a third recess in said forefoot region; and wherein said second sole portion further includes:

(vii) a fifth tread member in said forefoot region; and (viii) a third securing portion extending between and connecting said fourth tread member and said fifth tread member, and wherein said third securing portion is secured in said third recess of said first sole portion.

18. A shoe according to claim 12, wherein at least when the shoe contacts a ground surface a bottom portion of at least one of said tread members is substantially flat.

19. A shoe according claim 18, wherein when the bottom portion of the at least one tread member is substantially flat, the inner surface and the outer surface of the at least one tread member are substantially flat.

* * * * *